US009934892B2

(12) United States Patent
Sun et al.

(10) Patent No.: US 9,934,892 B2
(45) Date of Patent: Apr. 3, 2018

(54) METHOD FOR FABRICATING A VARISTOR DEVICE AND VARISTOR DEVICE

(71) Applicant: EPCOS AG, Munich (DE)

(72) Inventors: Dennis Sun, Zhuhai (CN); Jamie Jing, Zhuhai (CN); Qirong Li, Zhuhai (CN)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 15/102,645

(22) PCT Filed: Nov. 13, 2014

(86) PCT No.: PCT/EP2014/074532
§ 371 (c)(1),
(2) Date: Jun. 8, 2016

(87) PCT Pub. No.: WO2015/096932
PCT Pub. Date: Jul. 2, 2015

(65) Prior Publication Data

US 2016/0307673 A1 Oct. 20, 2016

(30) Foreign Application Priority Data

Dec. 24, 2013 (CN) ..... 2013 2 0859060 U

(51) Int. Cl.

| | |
|---|---|
| ***H01C 7/10*** | (2006.01) |
| ***H01C 7/102*** | (2006.01) |
| ***H01C 1/142*** | (2006.01) |
| ***H01C 17/28*** | (2006.01) |
| ***H01C 17/30*** | (2006.01) |
| *H01C 1/144* | (2006.01) |

(52) U.S. Cl.
CPC ..... *H01C 7/102* (2013.01); *H01C 1/142* (2013.01); *H01C 17/28* (2013.01); *H01C 17/281* (2013.01); *H01C 17/30* (2013.01); *H01C 1/144* (2013.01); *H01C 17/283* (2013.01)

(58) Field of Classification Search
CPC ..... H01C 7/102; H01C 1/142; H01C 17/28; H01C 17/281; H01C 17/30; H01C 1/114
USPC ..... 338/21, 13
See application file for complete search history.

(56) References Cited

U.S. PATENT DOCUMENTS 3,864,658 A 2/1975 Pitha et al.
4,211,994 A * 7/1980 Oda ..... H01C 7/12 338/21
5,142,263 A * 8/1992 Childers ..... H01C 17/006 338/21

(Continued)

FOREIGN PATENT DOCUMENTS

CN 101339821 A 1/2009
CN 102324290 A 1/2012

(Continued)

*Primary Examiner* — Kyung Lee
(74) *Attorney, Agent, or Firm* — Slater Matsil, LLP

(57) ABSTRACT

A method for fabricating a varistor device is presented. In an embodiment the method includes providing a base body for the varistor device, wherein the base body comprises a ceramic material, providing a basic material for a base metal electrode region on the base body, exposing the base body with the basic material to a temperature under a protective gas atmosphere such that the base metal electrode region is formed and firmly connected to the base body and completing the varistor device.

14 Claims, 1 Drawing Sheet

(56) References Cited

U.S. PATENT DOCUMENTS

| | | | | |
|---|---|---|---|---|
| 6,316,726 | B1 * | 11/2001 | Hidaka | H01G 4/228 174/538 |
| 6,507,269 | B2 * | 1/2003 | Imai | C04B 35/453 338/20 |
| 2007/0103268 | A1 * | 5/2007 | Luo | H01C 13/02 338/21 |

FOREIGN PATENT DOCUMENTS

| | | | |
|---|---|---|---|
| CN | 102881388 | A | 1/2013 |
| DE | 3405834 | A1 | 8/1985 |
| EP | 0495407 | A1 | 7/1992 |
| JP | S4980594 | | 8/1974 |
| JP | H0585002 | U | 11/1993 |
| JP | H0982506 | A | 3/1997 |
| JP | H10289808 | A | 10/1998 |
| JP | 2009146890 | A | 7/2009 |

* cited by examiner

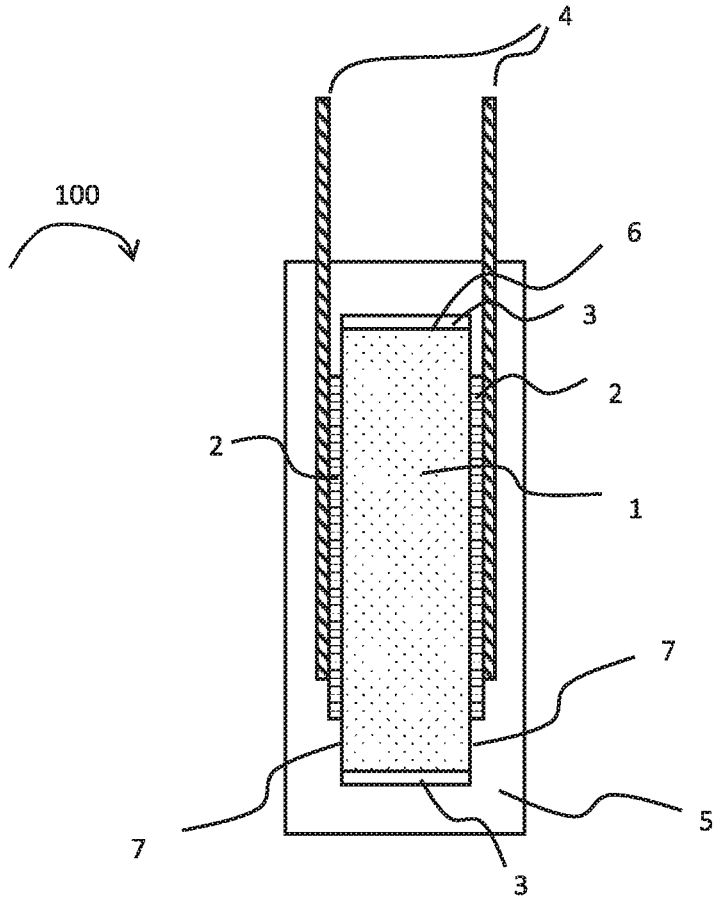
4
100
6
3
2
2
1
7
7
5
3

METHOD FOR FABRICATING A VARISTOR DEVICE AND VARISTOR DEVICE

This patent application is a national phase filing under section 371 of PCT/EP2014/074532, filed Nov. 13, 2014, which claims the priority of China patent application 201320859060.X, filed Dec. 24, 2013, each of which is incorporated herein by reference in its entirety.

TECHNICAL FIELD

The present disclosure relates to a method for fabricating a varistor device and a varistor device.

BACKGROUND

Varistors are known from CN 101339821 A and CN 102324290, for example.

SUMMARY OF THE INVENTION

Embodiments provide an improved varistor device, particularly, a varistor device which can be cost-efficiently fabricated.

One aspect of the present disclosure relates to a method for fabricating a varistor device comprising the steps of providing a base body for the varistor device, wherein the base body comprises a ceramic material, preferably, a material which is already sintered. Furthermore, the base body has, preferably, a disk-like shape. The method further comprises providing the base body with a basic material for a base metal electrode region. The base metal electrode region may constitute an electrode layer or, alternatively, contribute to an electrode of the varistor device, wherein said electrode may also comprise further components. Preferably, the base metal electrode region is an electrode layer. The method further comprises exposing the base body with the basic material to a temperature under a protective gas atmosphere such that the base metal electrode region is formed and the base metal electrode region is firmly connected to the base body of the varistor device. The protective gas is, preferably, a gas or gas additive which may be added to the ambient air. The protective gas atmosphere or ambient is, expediently, necessary to prevent an oxidation of, for example, the base body during the exposure of the base body to the temperature. Preferably, the protective gas is high purity nitrogen gas with a very low or functionally negligible oxygen content. The method further comprises completing the varistor device.

The ceramic material or the base body may also be a material which is not yet sintered and which is being sintered during the exposure of the base body to the temperature.

As an advantage of the present disclosure, the varistor device may be fabricated in a very cost-efficient way as the basic material which is used for the base metal electrode region in the varistor device is much cheaper than silver (Ag) or another noble metal for an electrode material, for example.

In an embodiment, during or after providing of the base body with the basic material for the base metal electrode region, the basic material is dried, e.g. at temperatures between 150° C. and 200° C.

In an embodiment, before the base body is provided with the basic material, the base body is provided with a passivation.

In an embodiment, the passivation protects the base body against chemical reactions and/or influences of the protective gas during the exposure of the base body to the temperature.

The passivation is, expediently, necessary to preserve or establish the desired electrical and/or semiconducting properties of the base body during the exposure of the base body to the temperature for an operation of the varistor device.

The passivation is, preferably, a passivation layer which is deposited onto the base body. The passivation may further be a surface passivation by which the base body is being coated during the provision of the base body with the passivation. Preferably, the passivation is electrically non-conducting.

Expediently, the base body is provided with the passivation such that sites or surface regions of the base body remain free and the basic material can, later on, be provided or applied in the free or uncoated regions e.g. in order to provide one or more electrodes of the varistor device.

In an embodiment, the temperature is a burn-in temperature for the basic material to be burned-in or mechanically connected to the base body such that the base metal electrode region is formed. Thereby, solvents or further agents which may be present in the basic material may be cast out of the basic material.

In an embodiment, the passivation is configured or provisioned to protect the base body against chemical reduction of the base body or parts of the base body, e.g. under reductive conditions of the protective gas atmosphere during the exposure to the temperature. Said reduction may, particularly, destroy or negatively influence the electrical or semiconducting properties of the base body.

In an embodiment, the passivation protects the base body against diffusion of corrosive or further agents from an outside of the base body into the base body, e.g. during later soldering and/or fabrication steps of the varistor device.

In an embodiment, after the base body is provided with a raw material for the passivation, the raw material is cured at temperatures of 300° C. to 600° C. in order to form the passivation. This process step may be necessary or expedient for the base body to be appropriately provided with the passivation.

In an embodiment, the base body is provided with the basic material by screen printing. According to this embodiment, the basic material for the base metal electrode region and/or the whole varistor device may be fabricated on a large scale, e.g. in mass production. In this way, the advantage of a cost-efficient material for the base metal electrode region, as mentioned above, can further be exploited. Alternatively, the base body can be provided with the basic material by any other expedient techniques.

In an embodiment, the base body is exposed to the temperature in a furnace, e.g. a conveyor furnace, with zones of different temperatures. In at least one of the zones, the base metal electrode region may then be formed and firmly connected to the base body.

In an embodiment, in a zone with temperatures between 450° C. and 800° C. the base body is exposed for a duration between 5 min and 30 min such that the base metal electrode region is formed and firmly connected to the base body. This embodiment allows for an expedient and advantageous formation and/or fixation or firm connection of the base metal electrode region.

In an embodiment, after the exposure of the base body to the temperature, the base body is provided with the solder contacts and/or solder straps. This embodiment, expediently, allows an electrical connection of the varistor device to any component, to which the varistor device is applied.

In an embodiment, the material of the solder contacts and/or the material of the solder straps is free of lead. This embodiment enables to meet the requirements of guidelines such as the "RoHS", short for Directive on the restriction of the use of certain hazardous substances in electrical and electronic equipment which was adopted by the European Union.

In an embodiment, completing the varistor device comprises providing the base body being fabricated so far with a protective and/or mechanically stabilizing outer coating or encapsulation.

A further aspect of the present disclosure relates to a varistor device comprising the ceramic base body and an electrode comprising the base metal electrode region, wherein the base metal electrode region is directly connected to the ceramic base body. The base metal electrode region may comprise a low or negligible oxygen content, e.g. less than 0.5 at % of oxygen, preferably less than 0.1 at % of oxygen.

By the provision of one or more non-noble, base metal electrode regions, expensive noble metals for electrode materials can, advantageously, be avoided, and, thus, fabrication costs of the varistor device can be reduced.

In an embodiment, the base metal electrode region contains copper or is completely made of copper. As an advantage, the electrically and thermally conductive properties of copper can be exploited for the varistor device accompanied by the advantages of the cost-efficiency of copper as an electrode material. Advantageously, this embodiment further allows for or facilitates the fabrication of varistor devices with large active or ceramic surface areas and comparably large AC operating voltages.

In an embodiment of the varistor device, an electrode surface of the ceramic base body comprises an area of at least 400 mm2. The electrode surface may coincide completely or substantially with a main surface of the base body, e.g. viewed from a top-view perspective (see below). According to this embodiment, the absorbing capacity for surge currents of the varistor device can, expediently and advantageously, be increased.

In an embodiment of the varistor device, the varistor device is designed for root mean square AC operating voltages of at least 75 V.

In an embodiment of the varistor device, the varistor device comprises the passivation, wherein the passivation is directly connected to the ceramic base body, e.g. in areas or surfaces in which the base metal electrode region does not directly contact the base body. According to this embodiment, the base body can most expediently and easily be protected by the passivation from external influences as mentioned above.

In an embodiment of the varistor device, the passivation is a lead-free glass, a ceramic material and/or an inorganic material.

In an embodiment of the varistor device, the ceramic base body comprises two base metal electrode regions which are connected each to a main surface of the ceramic base body. This embodiment is expedient in terms of an electrical connection of the varistor device.

In an embodiment, the passivation is arranged at an edge surface of the ceramic base body only, wherein the edge surface connects the main surfaces of the ceramic base body.

Accordingly, the edge regions of the ceramic base body which are most prone to degradation or corrosion during fabrication of the varistor device can, expediently, be protected against external influences, as e.g. geometrical edge effects at said boundary or edge areas can negatively influence the electrical properties of the varistor device, particularly in terms of the leakage current, energy absorption capacity, current-voltage characteristics but also in terms of life time or durability of the varistor device.

In an alternative embodiment of the varistor device, the passivation may be arranged at any side of the ceramic base body except the sides or regions of the ceramic base body in which the base metal electrode region is to be provided.

According to this embodiment, the passivating or protective effect of the passivation can—compared to the previously mentioned embodiment—even be increased or optimized.

In an embodiment of the varistor device, the base metal electrode region is a layer with a thickness between 5 μm and 30 μm. These thicknesses may be optimal or expedient in terms of forming a sufficiently covering or continuous electrode surface while at the same time allowing for a cost-efficient application of the base metal electrode region to the ceramic base body.

In an embodiment, the presented varistor device comprises similar or comparable electrical properties as compared to a varistor device of the prior art and/or one of the same kind but equipped with a noble metal electrode or electrode region (e.g. made of Ag) instead of the base metal electrode region. "Comparable" or "similar" shall mean in this respect that said electrical properties are not significantly worse or deteriorated in terms of e.g. the varistor voltage or the leakage current, as compared to the mentioned reference varistor device comprising noble metal electrodes.

In an embodiment of the varistor device, the varistor device is a strap and/or a disk varistor. According to this embodiment, the ceramic base body of the varistor device is formed from a monolithic material or component.

In an embodiment of the varistor device, the varistor device is not a multilayer varistor.

The varistor device may e.g. be applied in electrical appliances, communication devices and industrial power supplies in order to protect the respective device from over voltages, e.g. caused by lightning strikes.

Features which are described herein above and below in conjunction with different aspects or embodiments, may also apply for other aspects and embodiments. Further features and advantageous embodiments of the subject-matter of the disclosure will become apparent from the following description of the exemplary embodiment in conjunction with the FIGURES.

As the varistor device is, preferably, fabricated by the mentioned method, features which are described above and below in conjunction with the method for fabricating the varistor device may also relate to the varistor device itself and vice versa.

BRIEF DESCRIPTION OF THE DRAWINGS

FIG. 1 shows a schematic sectional view of a varistor device.

Like elements, elements of the same kind and identically acting elements may be provided with the same reference numerals in the FIGURES. Additionally, the FIGURES may be not true to scale. Rather, certain features may be depicted in an exaggerated fashion for better illustration of important principles.

DETAILED DESCRIPTION OF ILLUSTRATIVE EMBODIMENTS

FIG. 1 shows a schematic view of a varistor device 100 in a longitudinal section. The varistor device 100 may be a strap varistor and/or a disk varistor. The varistor device 100 comprises a base body 1. The base body 1 is, expediently made of a ceramic material. Furthermore, base body 1 comprises, preferably, a disc-like shape. A main extension direction of the disc may run horizontally in FIG. 1 and extend through main surfaces of the base body 1. The base body 1 comprises two main surfaces 7 (cf. e.g. left and right sides or faces in FIG. 1). The main surfaces 7 may relate to a front and back surface of the base body 1. The base body 1 further comprises one or more edge surfaces 6. Preferably, the edge surface 6 connects the main surfaces 7. According to the disk-like embodiment of the varistor device 100 or the base body, the edge surface 6 may further exhibit a circumferential surface of the base body 1.

Additionally or alternatively, the base body 1 may comprise a plane shape. Preferably, the base body 1 comprises or consists of zinc oxide (ZnO). Actually, the varistor functionality such as the nonlinear resistive behaviour may be due to the ZnO.

The varistor device 100 further comprises, preferably two, electrodes each of which applied to a main surface 7. Each of the electrodes may be constituted by a base metal electrode region 2. When it is referred to the electrode or base metal electrode region 2, it may automatically be referred to both of the electrodes 2 or base metal electrode region 2 shown in FIG. 1.

The base metal electrode region 2 is, preferably, made of copper. Alternatively, the base metal electrode region 2 may be made of any other base metal. The base metal electrode region 2, preferably, comprises a thickness between 5 μm and 30 μm. The base metal electrode regions 2 are, preferably, not significantly oxidized and may comprise an oxygen content of less than 0.1 at % only.

Although this is not explicitly indicated in FIG. 1, the electrode may also comprise further electrode materials or electrode layers, e.g. further metals which may act as a diffusion barrier for corrosive agents which may be present during the fabrication, e.g. during soldering of contacts to the varistor device 100. However, the base metal electrode region 2 is that region of the electrode which directly contacts the base body 1.

The base body 1 of the varistor device 100 comprises an electrode surface with an area of 100 $mm^2$ or more, preferably an area of 200 $mm^2$ or more such as 400 $mm^2$ or more. Said electrode surface (not explicitly indicated), preferably, pertains to the surface of the base body 1 which is connected to or covered by at least one of the base metal electrode regions 2. The electrode surface may coincide with the main surface 7 on each side of the base body 1.

The varistor device 100 may further be designed for root mean square AC operating voltages of 25 V or more, preferably of 50 V or more such as 75 V or more.

The varistor device 100 further comprises a passivation 3, preferably, a passivation layer, which is applied at the edge surface 6 of the base body 1, i.e. in FIG. 1 at the top and the bottom of the base body 1. The edge surface 6, preferably, comprise a smaller area as compared to the electrode surfaces or one the main surface 7 and may thus be more prone to degradation or corrosion during fabrication of the varistor device 100. The passivation 3, as shown in FIG. 1, is arranged at the edge surface 6 only.

Alternatively, the passivation 3 may—although not being explicitly indicated—be arranged at any site or outer side of the base body 1 except the sides or regions of the base body 1 in which the base metal electrode region is provided or applied to.

The passivation may be or comprise a lead-free glass, a ceramic material and/or an inorganic material. The passivation is provisioned for a protection of the base body against chemical reactions and/or influences, e.g., of a protective gas or gas atmosphere such as chemical reduction during the fabrication of the varistor device 100.

The varistor device 100 further comprises solder straps 4 which are soldered to the electrodes 2, e.g. at each side of the varistor device (cf. left and right lateral side in FIG. 1). The solder straps 4 are, preferably, made of tin (Sn). Although not explicitly indicated in FIG. 1, the electrodes 2 may comprise further electrode and/or solder materials. The varistor device 100 further comprises an outer coating 5.

In the following, the fabrication method of the varistor device is described. Said fabrication comprises providing the base body 1 for the varistor device 100, providing the base body with a basic material for the base metal electrode region and exposing the base body 1 with the basic material to a temperature under a protective gas atmosphere such that the base metal electrode region 2 is formed and the base metal electrode region 2 is firmly connected to the base body 1 of the varistor device 100. To this effect, the basic material may be or comprise a metal paste. Preferably, the basic material further comprises a binder or binding agent.

The basic material may be provided by screen printing or another printing method, for example.

During fabrication of the varistor device, the base body 1 may subsequently be coated by a raw material for the passivation. Subsequently, the base body 1 may be cured or baked in order to form the passivation 3, then coated with the basic material for the base metal electrode region, dried, exposed to the temperature, soldered, e.g. to the solder straps 4, and coated with the outer coating 5.

The solder straps 4 and/or said further solder contacts or layers can manually be soldered, soldered by dip soldering or reflow soldering, e.g. under evacuated and/or protective ambient or atmospheric conditions. Moreover, during soldering, flux materials and/or special lead-free solders, such as bars, pastes or wires may be used. In particular, the solder straps 4, may be bolts and/or bent or straight in shape. The method further comprises providing or coating of the so far fabricated or assembled components with the outer coating 5. The outer coating 5 may be an encapsulation and/or an organic or inorganic material, e.g. an epoxy resin.

The exposing step can be or comprise a burn-in step for the basic material, by which said material is converted into the base metal electrode region, and at the same time mechanically connected to the base body 1. During the fabrication, further electrode materials may be deposited or applied to the base body 1.

The exposing step is, preferably, carried out in a conveyor furnace or kiln, such as a belt-like kiln (not explicitly indicated in the FIGURE). Said furnace may expediently comprise a facility for applying a protective gas atmosphere, such as a high purity nitrogen with little air content. The conveyor furnace, preferably, comprises a heating zone, a high-temperature zone, a cooling zone and an outlet area. In the heating zone, the above-mentioned binder is preferably removed from the basic material. In the high-temperature zone, temperatures between 450° C. and 800° C. may expediently be applied, for the mentioned exposure or burning-in of the basic material. Preferably, the pre-fabricated base body is exposed to temperatures of the mentioned range for a duration between 5 min and 30 min. Duration and temperature may depend on the size of the respective device or base body. The thermal impact may need to be greater for larger devices as compared to smaller ones. In the cooling zone, the respective products may be cooled from the temperatures of the high-temperature zone, for example.

Particularly, the passivation may be cured—as mentioned above—at temperatures between 300° C. and 600° C. for 10 min to 4 h, e.g. at 560° C. for 1 h.

Particularly, the basic material may be dried in ambient air at temperatures between 100° C. and 300° C. for a duration of 2 min to 15 min, for example.

In an embodiment, the varistor device may have a length of 33.7 mm, a diameter of more than 32 mm, a varistor voltage of 216 V to 264 V, a leakage current of 2 μA, a flow capacity or voltage pulse shape of 8/20 μs and/or an energy absorption tolerance of 2 ms.

In an alternative embodiment, the varistor device may have a varistor voltage of 675 V to 825 V and/or a leakage current of more than 19 pA.

The scope of protection is not limited to the examples given herein above. The invention is embodied in each novel characteristic and each combination of characteristics, which particularly includes every combination of any features which are stated in the claims, even if this feature or this combination of features is not explicitly stated in the claims or in the examples.

The invention claimed is:

1. A method for fabricating a varistor device, the method comprising:

providing a base body for the varistor device, wherein the base body comprises a ceramic material;

providing the base body with a passivation, wherein the base body is provided with the passivation such that sites or surface regions of the base body remain free of the passivation;

providing a basic material for a base metal electrode region on the base body, wherein the base body is provided with the passivation before the providing the basic material on the base body, and wherein the basic material is provided or applied in regions that are free of, or uncoated by, the passivation in order to provide one or more electrodes of the varistor device;

exposing the base body with the basic material to a burn-in temperature, under a protective gas atmosphere, causing conversion of the base material into the base metal electrode region in the regions that are free of, or uncoated by, the passivation, such that the base metal electrode region is formed and firmly connected to the base body; and completing the varistor device by at least forming a coating or encapsulation.

2. The method according to claim 1, wherein, before providing the basic material on the base body, providing the base body with a passivation.

3. The method according to claim 2, wherein the base body is provided with the passivation such that sides or surface regions of the base body remain free and the basic material can, later on, be provided or applied in the free or uncoated regions in order to provide one or more electrodes of the varistor device.

4. The method according to claim 2, wherein providing the base body with a passivation comprises providing the base body with a raw material, and, after the base body is provided with the raw material, curing the raw material at temperatures from 300° C. to 600° C. in order to form the passivation.

5. The method according to claim 1, wherein providing the base body with the basic material comprises screen printing the base body with the basic material.

6. The method according to claim 1, wherein exposing the base body to the temperature comprises exposing the base body to the temperature in a furnace with zones of different temperatures.

7. The method according to claim 6, wherein the base body is exposed for a duration between 5 min and 30 min in a zone with temperatures between 450° C. and 800° C. such that the base metal electrode region is formed and firmly connected to the base body.

8. The method according to claim 1, wherein, after exposing the base body to the temperature, providing the base body with solder contacts and/or solder straps.

9. A varistor device comprising:

a ceramic base body, wherein the ceramic base body comprises two base metal electrode regions each connected to a main surface of two or more main surfaces of the ceramic base body;

an electrode comprising a base metal electrode region, wherein the base metal electrode region is directly connected to the ceramic base body;

a passivation directly connected to the ceramic base body, wherein the passivation is disposed only at an edge surface of the ceramic base body, and wherein the edge surface connects the two or more main surfaces of the ceramic base body; and an outer coating provided on the ceramic base body.

10. The varistor device according to claim 9, wherein the base metal electrode region contains copper.

11. The varistor device according to claim 9, further comprising a passivation directly connected to the ceramic base body.

12. The varistor device according to claim 11, wherein the ceramic base body comprises two base metal electrode regions each connected to a main surface of the ceramic base body, wherein the passivation is only arranged at an edge surface of the ceramic base body, and wherein the edge surface connects the main surfaces of the ceramic base body.

13. The varistor device according to claim 11, wherein the passivation is a lead-free glass, a ceramic material and/or an inorganic material.

14. The varistor device according to claim 9, wherein the base metal electrode region is a layer with a thickness between 5 μm and 30 μm.

* * * * *